US006349733B1

(12) United States Patent
Smith

(10) Patent No.: US 6,349,733 B1
(45) Date of Patent: Feb. 26, 2002

(54) WATER DELIVERY AND STORAGE SYSTEM AND METHOD

(75) Inventor: Jerry Wayne Smith, Advance, NC (US)

(73) Assignee: LeBleu Corporation, Advance, NC (US)

( * ) Notice: Subject to any disclaimer, the term of this patent is extended or adjusted under 35 U.S.C. 154(b) by 0 days.

(21) Appl. No.: 09/695,462

(22) Filed: Oct. 24, 2000

(51) Int. Cl.[7] ..... B65H 3/00

(52) U.S. Cl. ..... 137/1; 137/360; 137/559; 137/587; 137/899; 141/1; 141/324; 141/349

(58) Field of Search ..... 141/348, 349, 141/326, 1, 98, 324, 95, 231; 137/899, 382, 559, 572, 587, 360

(56) References Cited

U.S. PATENT DOCUMENTS 1,049,901 A * 1/1913 Muller ..... 137/343
1,206,241 A 11/1916 Peters
4,066,551 A 1/1978 Stern ..... 210/282
5,029,612 A 7/1991 Simbulan ..... 137/592
5,240,043 A 8/1993 Campbell ..... 137/899
5,349,992 A * 9/1994 Gallo et al. ..... 141/18
5,819,773 A * 10/1998 Kronowitt ..... 137/1
5,950,662 A 9/1999 Scott ..... 137/357
5,975,133 A 11/1999 Nalewajski ..... 137/587

* cited by examiner

*Primary Examiner*—A. Michael Chambers
(74) *Attorney, Agent, or Firm*—Myers Bigel Sibley & Sajovec

(57) ABSTRACT

A water storage and dispensing system includes a water storage tank, a dispenser, and a conduit system extending between and fluidly connecting the storage tank and the dispenser. The conduit system includes an outer shell conduit defining a conduit passage therein, and an inner tubing extending through the conduit passage. The inner tubing is in fluid communication with each of the storage tank and the dispenser and is arranged and configured to convey water from the storage tank to the dispenser. Preferably, the inner tubing is formed of instrument grade tubing. Preferably, the shell conduit is formed of PEX.

28 Claims, 4 Drawing Sheets

WATER DELIVERY AND STORAGE SYSTEM AND METHOD

FIELD OF THE INVENTION

The present invention relates to water handling devices, and, more particularly, to a system for delivering potable water to a building structure such as a residence or business and for storing and dispensing the water in the building structure.

BACKGROUND OF THE INVENTION

As consumers have become more weight and health conscious, there has been a substantial and increasing trend toward the consumption of drinking water in place of soft drinks or other beverages. Moreover, many consumers dislike the taste and smell of commonly available tap water, whether it is sourced from local wells or municipal supplies. Further, growing awareness of pollutants in groundwater supplies and chemical additives used in municipal supplies has caused concern that tap water is, in fact, not healthy. As a natural result of the foregoing, consumer demand for both quality water and, in particular, for purified drinking water, has increased dramatically over the last decade. In particular, demand for bottled purified water has grown exponentially over the last few years.

One common method for providing purified water in a residence or a business is to provide a dispenser stand adapted to hold large, replaceable bottles (typically five gallon plastic bottles). A bottle is mounted on the stand until it is drained of water, and then the bottle is replaced with a new, full bottle. A delivery service may bring full bottles of water and may take away empty bottles for refilling. These dispensers may be unattractive and space-consuming. Many users choose to keep the unused bottles in the immediate vicinity of the dispenser stand in order to reduce the distance the bottles must be carried for mounting, and these additional bottles may likewise be unattractive and space-consuming. To provide for secure delivery of the water bottles, delivery personnel often must be provided with access to the interior of the residence or business or someone must be present to accept delivery.

SUMMARY OF THE INVENTION

According to preferred embodiments of the present invention, a water storage and dispensing system includes a water storage tank, a dispenser, and a conduit system extending between and fluidly connecting the storage tank and the dispenser. The conduit system includes an outer shell conduit defining a conduit passage therein, and an inner tubing extending through the conduit passage. The inner tubing is in fluid communication with each of the storage tank and the dispenser and is arranged and configured to convey water from the storage tank to the dispenser.

Preferably, the inner tubing is formed of instrument grade tubing. More preferably, the inner tubing meets the requirements of NSF 51. The inner tubing may be formed of polyethylene. The shell conduit may be formed of crosslinked polyethylene (PEX).

The storage tank may include a translucent sight glass in a side wall thereof The storage tank may include a fill port and a lockable cap on the fill port. A dispensing faucet may be located adjacent a lower portion of the storage tank, the faucet being operable to dispense water directly from the storage tank. An ultraviolet bulb may be disposed within the storage tank.

According to further preferred embodiments of the present invention, a building structure includes at least one wall and a water storage and dispensing system. The water storage and dispensing system includes a water storage tank, a dispenser, and a conduit system extending between and fluidly connecting the storage tank and the dispenser. The conduit system includes an outer shell conduit defining a conduit passage therein, and an inner tubing extending through the conduit passage. The inner tubing is in fluid communication with each of the storage tank and the dispenser and is arranged and configured to convey water from the storage tank to the dispenser. Portions of each of the shell conduit and the inner tube are disposed in the wall such that the inner tubing is shielded by the shell conduit in the wall.

The wall may include first and second spaced apart, lengthwise extending wall panels defining a wall cavity therebetween with the portions of the shell conduit and the inner tube being disposed in the wall cavity and extending along the length of the wall. The wall may further include at least one vertically extending stud interposed between the first and second wall panels and having a stud hole defined therein. The shell conduit and the inner tube extend through the stud hole.

According to further preferred embodiments of the present invention, a liquid storage system for receiving liquid from outside a building structure and storing the liquid within the building structure includes a storage tank defining an interior volume adapted to hold the liquid. The storage tank includes a vertically extending side wall, a fill port defined in the side wall and in fluid communication with the interior volume, and an overflow port formed in the side wall and in fluid communication with the interior volume. The overflow port is located below the fill port. A faceplate is adapted to be mounted at an exterior location on the building structure. The faceplate includes a fill opening and an overflow opening each formed in the faceplate. The overflow opening is located below the fill opening. A fill conduit fluidly connects the fill port and the fill opening. An overflow conduit fluidly connects the overflow port and the overflow opening.

Preferably, the fill conduit and the overflow conduit are flexible. The faceplate may include a base plate and a cover pivotably connected to the base plate with the fill opening and the overflow opening being formed in the base plate. A lock is provided to secure the cover over the base plate.

According to method embodiments of the present invention, a method of delivering a liquid to and storing the liquid in a storage tank includes: directing the liquid into a fill opening located on the exterior of a building structure such that the liquid flows through the fill opening, through a fill conduit, through a fill port in a side wall of the storage tank and into an interior volume of the storage tank; continuing to fill the storage tank with the liquid until the level of the liquid in the storage tank rises to an overflow port in the side wall of the storage tank whereupon a portion of the liquid flows through the overflow port, through an overflow conduit, and through an overflow opening located on the exterior of the building; and discontinuing filling of the storage tank responsive to the liquid exiting through the overflow opening.

Objects of the present invention will be appreciated by those of ordinary skill in the art from a reading of the Figures and the detailed description of the preferred embodiments which follow, such description being merely illustrative of the present invention.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
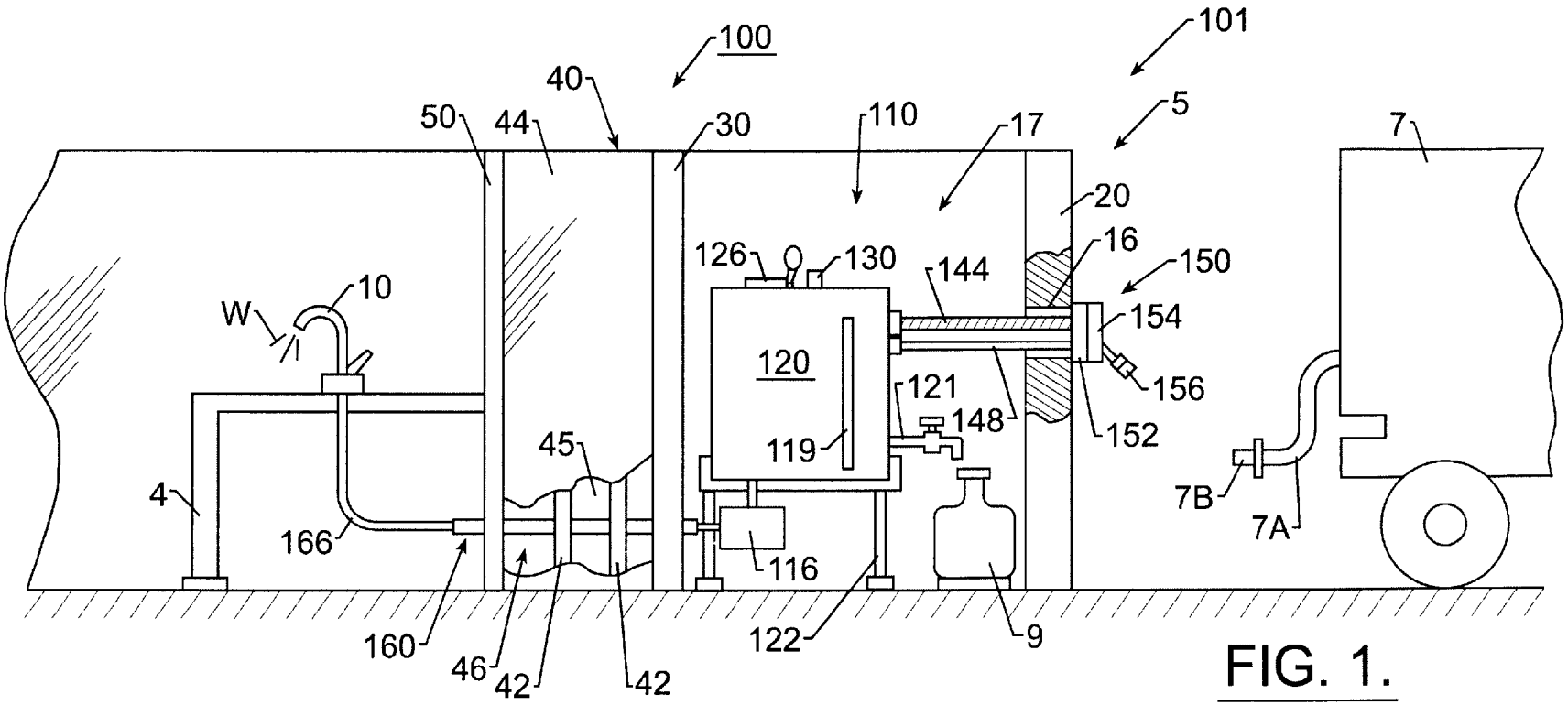
FIG. 1 is a schematic, fragmentary view of a water delivery, storage and dispensing system according to the present invention including a water storage and dispensing system installed in a building structure.

With reference to FIG. 1, a water delivery, storage and dispensing system according to the present invention is shown therein and generally designated 101. The system 101 includes a water storage and dispensing system 100, a mobile delivery tank vehicle 7, and a bottle 9. The system 100 is installed in a building structure 5. The building structure 5 may be, for example, a residence or commercial structure. Generally, and as discussed in more detail below, the system 100 is operable to receive and store water from a suitable source and to dispense the water from a faucet 10 and/or another dispenser or dispensers. In particular, the system 100 may be supplied with water W from the vehicle 7 or from the bottle 9. Preferably, and as illustrated and described below in more detail, the system 100 is integrated into the building structure 5 in a convenient, secure and unobtrusive manner. The system 100 is particularly advantageous for storing and supplying purified water. Preferably, the system 100 is used to store and supply only purified water.

With continued reference to FIG. 1, the water storage and dispensing system 100 includes a storage unit 110. The storage unit 110 is housed in a utility room 17 or the like of the building structure 5 such that the storage unit 110 is out of view but accessible. Preferably, though not necessarily, the utility room 17 is formed in part by an exterior wall 20 of the building structure 5.

Figure 2:
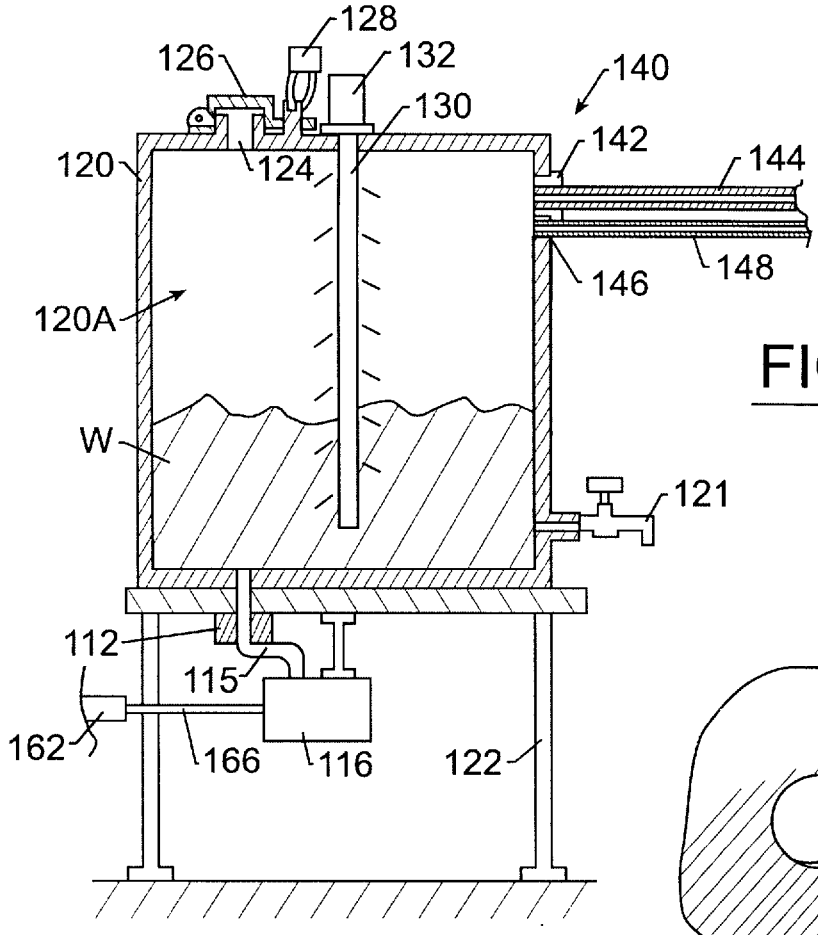
FIG. 2 is a cross-sectional view of a storage unit of the system of FIG. 1.

With reference to FIGS. 1 and 2, the storage unit 110 includes a storage tank 120, preferably formed of stainless steel. The storage tank 120 defines an interior volume 120A, preferably having a capacity of between about 10 and 50 gallons. The storage tank 120 is supported by a stand 122.

A selectively and, preferably, manually operable faucet 121 is positioned near the lower end of the tank 120 and communicates with the interior volume 120A. The faucet 121 may be used to dispense water from the tank 120 locally or in the event of an emergency (e.g., loss of power) or whenever water is desired locally.

A vertically extending sight glass 119 is provided in a sidewall of the storage tank 120. The sight glass 119 is formed of a transparent or translucent material and allows an observer to visually gauge the level of the water W in the tank 120. Preferably, the sight glass 119 is formed of glass.

The storage tank 120 has a fill port 124 covered by a cap 126. The cap 126 is hingedly coupled to the upper wall of the storage tank 120 and is secured over the fill port 124 by a lock 128. Other means for securing the cap 126 to the tank 120 may be provided. For example, a lock may be provided integral with the cap 126 and/or the cap 126 may be fully removable from the tank 120.

An ultraviolet (UV) bulb extends vertically within the interior volume 120A and into the water W. The UV bulb 130 is supported, powered and controlled by a light fixture 132 (e.g., including a ballast). The UV bulb 130 serves to suppress the growth of microbes in the stored water W. Preferably, the UV bulb 130 is illuminated at substantially all times when water is disposed in the tank 120.

An electric pump 116 is operatively connected at its inlet side to the lower interior of the tank 120 by a tubing 115. A filter 112 is interposed between the interior volume 120A and the pump 116 to capture any debris which may be in the water W including, for example, glass in the event the UV bulb 130 is broken.

The pump 116 is operatively connected at its outlet side to tubing 166. The pump 116 has a pressure sensor switch which causes the pump 116 to operate when the pressure at the inlet side (i.e., the pressure in the tubing 166) drops below a threshold pressure and to de-activate when the pressure exceeds that or another threshold pressure.

With reference to FIGS. 1, 2, 5 and 6, the tubing 166 forms a part of a conduit assembly 160. The tubing 166 has an interior wall 166A defining a passage 168. The water W flows through the passage 168.

The tubing 115 and the tubing 166 are formed of a material suitable for conveying potable water, especially purified water. Preferably, the tubings 115, 166 are formed of instrument grade tubing. More preferably, the tubings 115, 166 meet the requirements of NSF International Standard 51 (NSF 51) and the requirements of the United States Food and Drug Administration for dry food contact (FDA, CFR 21 Part 177). Preferably, the tubings 115, 166 are flexible. Suitable instrument grade tubing materials include PARFLEX™ Series E polyethylene tubing (e.g., product numbers E-43-0100 and E-63-0100) available from Parker Hannifin Corporation, Parflex Division, of Ravenna, Ohio. Preferably, the tubings 115, 166 each have an inner diameter A (FIG. 5) of between about 0.17 inch and 0.25 inch and an outer diameter of between about ¼ inch and ⅜ inch.

The conduit system 160 further includes an outer shell conduit or piping 162. The shell conduit 162 is preferably stronger than the tubing 166. The conduit 162 has an interior wall 162A defining a passage 164. The tubing 166 is received in the passage 164. Preferably, the conduit 162 has an inner diameter B (FIG. 5) of at least 7⁄16 inch and an outer diameter of at least ½ inch. Preferably, the shell conduit 162 is formed of crosslinked polyethylene (PEX). Alternatively, the shell conduit 162 may be formed of polybutylene or polyvinyl chloride. Preferably, the shell conduit has a tensile strength of at least about 100 psi. Suitable tubings include Quest Pex™ and Dura-Pex™ PEX tubings. The shell conduit 162 may be flexible. Preferably, the conduit system 160 is plumbed into the structure 5 during the construction thereof, for example, before the sheetrock or other wall covering is installed. Alternatively, the conduit system 160 may be retrofitted into the structure 5.

Figure 5:
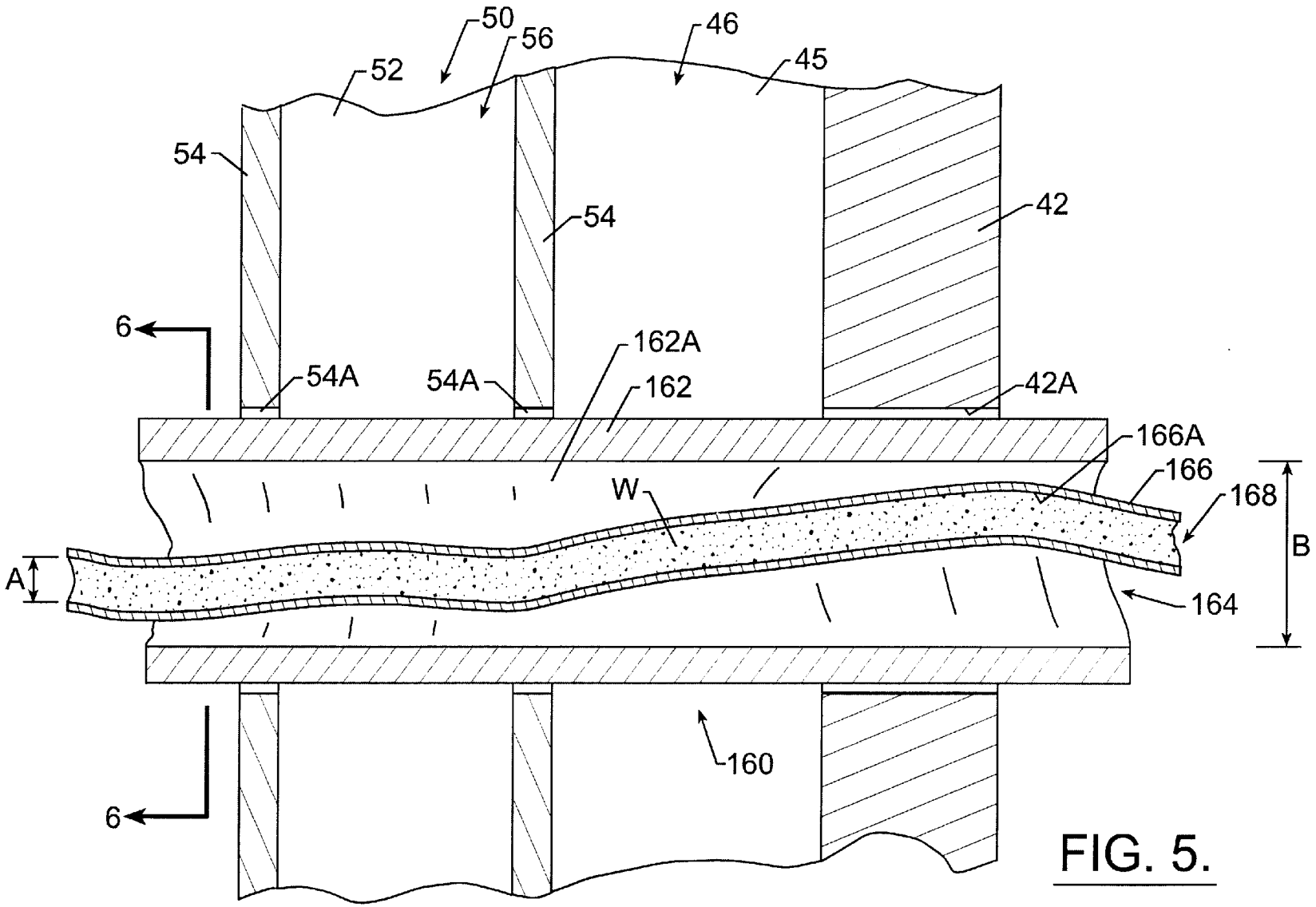
FIG. 5 is a partial, cross-sectional view of the building structure and a conduit assembly of the system of FIG. 1.
Figure 6:
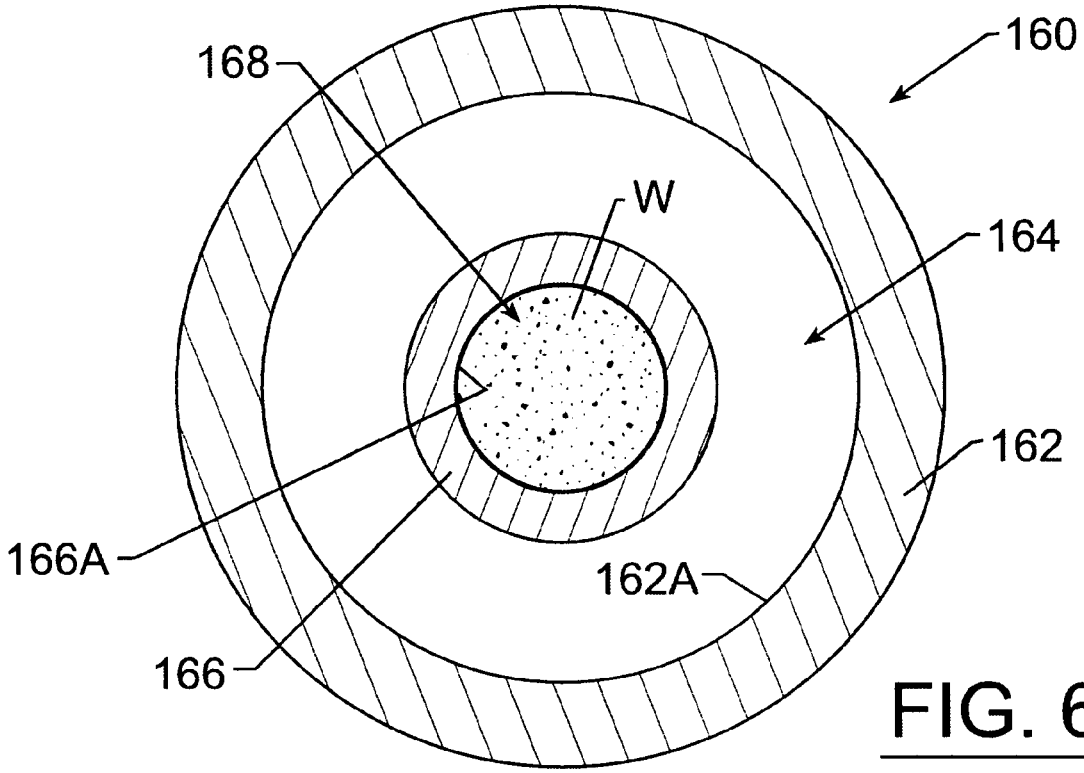
FIG. 6 is a cross-sectional view of the conduit assembly of FIG. 5 taken along the line 6—6 of FIG. 5.

The conduit system 160 extends through, for example, walls 30, 40 and 50 of the building structure 5. As best seen in FIG. 5, at least the portions of the conduit system 160 disposed within the walls 30, 40 and 50 include both the shell conduit 162 and the inner tubing 166. For example, the wall 40 includes a sheetrock panel 44 (see FIG. 1), an outer wall panel 45 (which may also be sheetrock) and a plurality of wooden support studs 42 (see FIGS. 1 and 5). The sheetrock 44 and the wall panel 45 form a cavity 46 (which is divided by the studs 42) therebetween. The conduit 162 and the tubing 166 extend through the cavity 46 and holes 42A in the studs 42. The conduit 162 and the tubing 166 are thereby hidden within the wall 40 between the sheetrock 44 and the outer wall panel 45.

Similarly, the orthogonal wall 50 includes sheetrock panels 54 and an interposed wooden support stud 52. The sheetrock panels 54 form a cavity 56 therebetween. The conduit 162 and the tubing 166 extend through the cavity 56 and holes 54A in the sheetrock panels 54. The wall 30 is constructed in a similar manner to the wall 50 and the conduit system 160 extends therethrough in the same manner.

The tubing 166 (and, optionally, the conduit 162) extends through a cabinet 4 to a dispenser 10. The dispenser 10 may be, as shown, a fixed faucet. Alternatively, the dispenser 10 may be an ice maker, a coffee maker, a water fountain or any other suitable dispenser. The system 100 may include multiple said dispensers and each dispenser may have its own, parallel tubing 166.

The conduit assembly 160 allows the system 100 to be effectively plumbed into the building structure 5 while meeting common and conventional building codes and nonetheless providing high water quality at the dispenser 10. More particularly, the instrument grade, inner tubing 166 prevents leaching of the water into the tubing 166 and resulting contamination. Such contamination may have deleterious effects on the taste and purity of the water W, particularly in the case of purified water. The preferably stronger conduit 162 shields the inner tubing 166 from damage, both during construction of the building structure 5 and/or installation of the conduit assembly 160, and also thereafter. The shell conduit 162 shields the inner tubing 166 from abrasion at sharp or rough comers or holes (e.g., at the edges of the holes 42A, 54A). The shell conduit 162 may also protect the inner tubing 166 from piercing by drywall nails and the like.

As noted above, the storage tank 120 may be filled using one or more bottles 9. This is accomplished by unlocking and removing the lock 128, lifting the cap 126 away from the fill port 124, and pouring the water W from the bottle 9 into the tank 120 through the fill port 124. The operator may monitor the fill progress using the sight glass 119. After the operator is through filling the tank 120, he or she may reclose and relock the cap 126.

Figure 3:
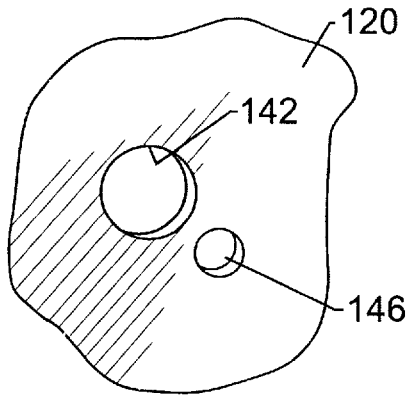
FIG. 3 is a partial, enlarged, front view of the storage unit of FIG. 2.
Figure 4:
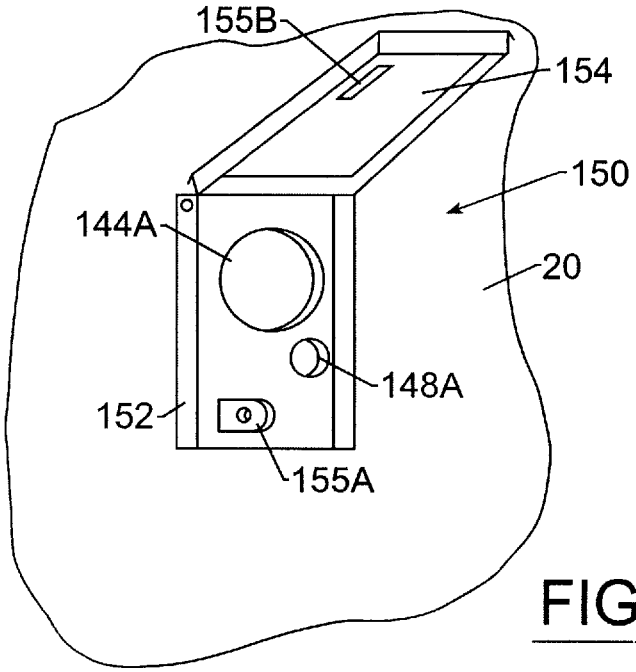
FIG. 4 is a partial, perspective view of an exterior wall of the building structure and a face plate assembly of the system of FIG. 1.

The tank 120 may also be filled from outside the building structure 5, for example, by the vehicle 7. With reference to FIGS. 2 and 3, a fill port 142 is formed in the sidewall of the tank 120. A smaller overflow port 146 is formed in the sidewall of the tank 120 below the fill port 142.

A faceplate assembly 150 is mounted on the outside of the exterior wall 20 of the building structure 5. The faceplate assembly 150 includes a base plate 152 and a cover plate 154 hingedly coupled to the base plate 152. When the faceplate 154 is in a closed position as shown in FIG. 1, a tab 155A, which is fixedly secured to the base plate 152, extends through an opening 155B in the faceplate 154 to receive a lock 156. The base plate 152 also includes a fill opening 144A and an overflow opening 148A positioned below the opening 144A.

A conduit 144 extends between the fill port 142 and the opening 144A through a hole 16 in the wall 20. A conduit 148 extends between the overflow port 146 and the opening 148A through the hole 16 in the wall 20. Preferably, the opening 148A is positioned vertically below the port 142. Preferably, the conduit 144 is positioned entirely below the conduit 148.

When the operator desires to fill the tank 120, the operator unlocks and removes the lock 156 and opens the faceplate 154. A hose 7A of the vehicle 7 is brought to the faceplate assembly 150 and a nozzle 7B is inserted into or otherwise connected to the port 144A. The water W from the tank vehicle 7 is pumped or otherwise fed from the vehicle 7 to the opening 144A. The water W flows through the conduit 144 and the fill port 142 and into the tank 120. As the level of the water W in the storage tank 120 rises and reaches the overflow port 146, the water W spills through the overflow port 146, through the conduit 148 and out through the opening 148A. When the overflowing water W spills out from the opening 148A, the operator is thereby alerted that the tank 120 is full and ceases feeding water W to the opening 144A. The operator may then reclose and relock the faceplate 154.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A method of delivering a liquid to and storing the liquid in a storage tank, said method comprising the steps of:

directing the liquid into a fill opening located on the exterior of a building structure such that the liquid flows through the fill opening, through a fill conduit, through a fill port in a side wall of the storage tank and into an interior volume of the storage tank;

continuing to fill the storage tank with the liquid until the level of the liquid in the storage tank rises to an overflow port in the side wall of the storage tank whereupon a portion of the liquid flows through the overflow port, through an overflow conduit, and through an overflow opening located on the exterior of the building; and discontinuing filling of the storage tank responsive to the liquid exiting through the overflow opening.

2. A water storage and dispensing system comprising:

a) a water storage tank;

b) a dispenser; and c) a conduit system extending between and fluidly connecting said storage tank and said dispenser, said conduit system including:

an outer shell conduit defining a conduit passage therein; and an inner tubing extending through said conduit passage, said inner tubing being in fluid communication with each of said storage tank and said dispenser and arranged and configured to convey water from said storage tank to said dispenser.

3. The system of claim 2 wherein said inner tubing is formed of instrument grade tubing.

4. The system of claim 3 wherein said inner tubing meets the requirements of NSF 51.

5. The system of claim 3 wherein said inner tubing is formed of polyethylene.

6. The system of claim 2 wherein said shell conduit is formed of PEX.

7. The system of claim 2 including a pump operative to force water from said storage tank and through said inner tubing to said dispenser.

8. The system of claim 2 wherein said storage tank includes a translucent sight glass in a side wall thereof.

9. The system of claim 2 wherein said storage tank includes a fill port and a lockable cap on said fill port.

10. The system of claim 2:

a) wherein said water storage tank defines an interior volume adapted to hold the water and includes:
- a vertically extending side wall;
- a fill port defined in said side wall and in fluid communication with said interior volume; and
- an overflow port formed in said side wall and in fluid communication with said interior volume;
- wherein said overflow port is located below said fill port; and b) further including:
- a faceplate including:
  - a fill opening defined in said faceplate; and
  - an overflow opening formed in said faceplate;
  - wherein said overflow opening is located below said fill opening;
  - a fill conduit fluidly connecting said fill port and said fill opening; and
  - an overflow conduit fluidly connecting said overflow port and said overflow opening.

11. The system of claim 8 wherein said storage tank further includes a second fill port to allow the water storage tank to be filled directly.

12. The system of claim 2 including a dispensing faucet located adjacent a lower portion of said storage tank and operable to dispense water directly from said storage tank.

13. The system of claim 2 including an ultraviolet bulb disposed within said storage tank.

14. A building structure comprising:

a) at least one wall; and b) a water storage and dispensing system comprising:
- a water storage tank;
- a dispenser; and
- a conduit system extending between and fluidly connecting said storage tank and said dispenser, said conduit system including:
  - an outer shell conduit defining a conduit passage therein; and
  - an inner tubing extending through said conduit passage, said inner tubing being in fluid communication with each of said storage tank and said dispenser and arranged and configured to convey water from said storage tank to said dispenser;

c) wherein portions of each of said shell conduit and said inner tube are disposed in said wall such that said inner tubing is shielded by said shell conduit in said wall.

15. The building structure of claim 14 wherein said inner tubing is formed of instrument grade tubing.

16. The building structure of claim 14 wherein said shell conduit is formed of PEX.

17. The building structure of claim 14 wherein:

said wall has a length and includes first and second spaced apart, lengthwise extending wall panels defining a wall cavity therebetween; and said portions of said shell conduit and said inner tube are disposed in said wall cavity and extend along said length of said wall.

18. The building structure of claim 17 wherein:

said wall further includes at least one vertically extending stud interposed between said first and second wall panels and having a stud hole defined therein; and said shell conduit and said inner tube extend through said stud hole.

19. The building structure of claim 14 including a pump operative to force water from said storage tank and through said inner tubing to said dispenser.

20. The building structure of claim 14 wherein said storage tank includes a translucent sight glass in a side wall thereof.

21. The building structure of claim 14 wherein said storage tank includes a fill port and a lockable cap on said fill port.

22. The building structure of claim 14:

a) wherein said water storage tank defines an interior volume adapted to hold the water and includes:
- a vertically extending side wall;
- a fill port defined in said side wall and in fluid communication with said interior volume; and
- an overflow port formed in said side wall and in fluid communication with said interior volume;
- wherein said overflow port is located below said fill port; and b) further including:
- an exterior building wall;
- a faceplate mounted on said exterior building wall and including:
  - a fill opening defined in said faceplate; and
  - an overflow opening formed in said faceplate;
  - wherein said overflow opening is located below said fill opening;
- a fill conduit fluidly connecting said fill port and said fill opening; and
- an overflow conduit fluidly connecting said overflow port and said overflow opening.

23. The building structure of claim 22 wherein said storage tank further includes a second fill port to allow the water storage tank to be filled directly.

24. The building structure of claim 14 including a dispensing faucet located adjacent a lower portion of said storage tank and operable to dispense water directly from said storage tank.

25. The building structure of claim 14 including an ultraviolet bulb disposed within said storage tank.

26. A liquid storage system for receiving liquid from outside a building structure and storing the liquid within the building structure, said system comprising:

a) a storage tank defining an interior volume adapted to hold the liquid and including:
- a vertically extending side wall;
- a fill port defined in said side wall and in fluid communication with said interior volume; and
- an overflow port formed in said side wall and in fluid communication with said interior volume;

wherein said overflow port is located below said fill port;

b) a faceplate adapted to be mounted at an exterior location on the building structure, said faceplate including:

a fill opening defined in said faceplate; and an overflow opening formed in said faceplate;

wherein said overflow opening is located below said fill opening;

c) a fill conduit fluidly connecting said fill port and said fill opening; and d) an overflow conduit fluidly connecting said overflow port and said overflow opening.

27. The system of claim 26 wherein said fill conduit and said overflow conduit are flexible.

28. The system of claim 26 wherein said faceplate includes a base plate and a cover pivotably connected to the base plate and said fill opening and said overflow opening are formed in said base plate, and including a lock to secure said cover over said base plate.

* * * * *

UNITED STATES PATENT AND TRADEMARK OFFICE

CERTIFICATE OF CORRECTION

PATENT NO. : 6,349,733 B1
DATED : February 26, 2002
INVENTOR(S) : Jerry Wayne Smith It is certified that error appears in the above-identified patent and that said Letters Patent is hereby corrected as shown below:

Column 7,
Line 38, delete “8” and insert -- 10 --.

Signed and Sealed this

Twenty-fourth Day of September, 2002

*Attest:*

*Attesting Officer*

JAMES E. ROGAN
*Director of the United States Patent and Trademark Office*